US011679573B2

(12) United States Patent
Johanson

(10) Patent No.: US 11,679,573 B2
(45) Date of Patent: Jun. 20, 2023

(54) APPARATUS FOR DIE FILLING

(71) Applicant: Kerry Johanson, Gainesville, FL (US)

(72) Inventor: Kerry Johanson, Gainesville, FL (US)

( * ) Notice: Subject to any disclaimer, the term of this patent is extended or adjusted under 35 U.S.C. 154(b) by 259 days.

(21) Appl. No.: 16/950,243

(22) Filed: Nov. 17, 2020

(65) Prior Publication Data

US 2022/0152968 A1 May 19, 2022

(51) Int. Cl.

| | |
|---|---|
| ***A61J 3/10*** | (2006.01) |
| ***B30B 15/30*** | (2006.01) |
| ***B30B 11/02*** | (2006.01) |

(52) U.S. Cl.

CPC ..... *B30B 15/304* (2013.01); *A61J 3/10* (2013.01); *B30B 11/027* (2013.01)

(58) Field of Classification Search

None

See application file for complete search history.

(56) References Cited

U.S. PATENT DOCUMENTS 9,067,377 B2 * 6/2015 Dickinger ..... B29B 7/10

FOREIGN PATENT DOCUMENTS

KR 100650431 B1 * 10/2005
KR 101854806 B1 * 10/2017
WO WO-2015186905 A1 * 12/2015 ..... A61J 3/10

* cited by examiner

*Primary Examiner* — Yung-Sheng M Tsui
(74) *Attorney, Agent, or Firm* — C. Richard Lohrman; Lohrman IP Law LLC

(57) ABSTRACT

The invention presented is a die filling apparatus that includes a unique powder feed assembly that includes a novel plurality of vertically stacked drive gear-feed gear pairs that move filling powder through a series of sieves into a die used for compressing powder into a tablet. At least the bottom feed gear includes a plurality of logarithmic vanes or blades with an offset axis of rotation. Also presented is a method to fabricate pellets from powder using an apparatus to form a pellet.

20 Claims, 13 Drawing Sheets

APPARATUS FOR DIE FILLING

STATEMENT REGARDING FEDERALLY SPONSORED RESEARCH OR DEVELOPMENT

This invention was made with government support under contract number HQ0147-19-C-7102 awarded by the Department of Defense Military Defense Agency. The government has certain rights in the invention.

FIELD OF THE INVENTION

The field of the invention relates generally to manufacture of chemical or pharmaceutical products, more specifically to manufacture of tablets from chemical and pharmaceutical powders and still more specifically to the use of dies to produce tablets from commercial chemical and pharmaceutical powders.

BACKGROUND OF THE INVENTION

Powders are a common type of product that can be manufactured from various types of materials such as organic chemicals and inorganic materials, for example the chemicals found in pharmaceutical products such as thyroxine tablets and metallic or salt mixture powders such as powders used in the manufacture of thermal batteries and ceramic substrates found in electronics.

Powder(s) are often formed into a tablet that is a convenient form for handling a powder both for delivery of a product such as aspirin to a patient or a repeatable specific quantity of a metallic powder such as lithium for a thermal battery manufacturer. However, there are some inherent problems in the manufacture of tablets, especially in the fabrication of tablets used, for example, in the pharmaceutical and high technology industries. In such industries, repeatable uniformity of the content of each tablet is extremely important. Cavitation of the powder as the tablet is formed can defeat uniformity by forming air pockets within a tablet and/or producing tablets in which the total quantity of powder is below or above acceptable ranges for the specific tablet.

In the prior art, Korean patent KR101854806 (Woo) discloses a stack of feed impellers that feeds powder to compression assemblies such as die filling apparatuses. However, there is no provision for preparing the powder to prevent cavitation during tablet formation. In addition, the '806 patent discloses only radial symmetric impellers which would allow buildup of powder caught directly under the axes of rotation of the impellers. U.S. Pat. No. 9,067,377 (Dickinger et al.) discloses a single rotating blade to move powder to a compression apparatus. However, there is no component to reduce or eliminate cavitation to ensure uniformity and the several impeller embodiments are all radially symmetrical. Korean Patent No. KR101615331 (Kang Seok Jin, et al.), International Patent Publication No. WO2015186905 (Woo Jongsoo, et al.), and Korean Patent No. KR101288210 (Hew Young Kim) are a few other examples of the prior art that teach the use of impellers in tablet forming machines, but all lack any device to ensure tablet uniformity or prevent powder buildup within the impeller assemblies.

Therefore, it can be seen that there is a need in the field for a device or apparatus that can ensure powder uniformity in powders moved to die filling assemblies.

SUMMARY OF THE INVENTION

The present invention broadly comprises a powder feed assembly comprising: a plurality of drive gear-feed gear pairs, wherein in each of the pairs the drive gear is operatively attached to the feed gear; a plurality of housing covers-housings assemblies wherein each of the plurality of housing covers-housings assemblies holds one of the plurality of drive gear-feed gear pairs and wherein each one of the plurality of housing covers-housings assemblies are stacked one above the other; at least one sieve housing holding a sieve wherein the housing is stacked under a bottom one of the housings; and, a powder feed power drive operatively attached to each of the drive gears. In one embodiment, the powder feed assembly is mounted on a base defining at least one die hole.

The present invention also broadly comprises an apparatus for die filling with a powder comprising: a powder dispensing assembly including: a feed hopper to receive a supply of powder; a powder feed device operatively attached to the feed hopper; a dispensing drive mechanism operatively attached to the powder feed device; and a powder feed assembly that includes: a plurality of drive gear-feed gear pairs, wherein in each of the pairs each drive gear is operatively attached to the feed gear; a plurality of housing covers-housings assemblies wherein each of the plurality of housing covers-housings assemblies holds one of the plurality of drive gear-feed gear pairs and wherein each one of the plurality of housing covers-housings assemblies are stacked one above the other; at least one sieve housing holding a sieve wherein the housing is attached to one of the housings; and, a powder feed power drive operatively attached to each of the drive gears. The apparatus also includes a die; and, at least one press. The at least one press forms the received powder into the die to form a pellet. A top feed gear receives powder from the dispensing drive mechanism and the feed gears feed the powder to a succeeding feed gear. The at least one die receives powder from the at least one sieve. The apparatus is mounted on a base, the base defining at least one die hole.

The present invention also broadly comprises a method for fabricating a pellet from a powder utilizing the apparatus broadly described above, the method comprising: dispensing a known quantity of powder from the powder dispensing assembly into a feed orifice in the top housing of the assembly of housings; rotating each of the plurality of drive gear-feed gear pairs in both a counterclockwise and clockwise direction; driving the known quantity of powder through a first sieve into the feed gear of a second drive gear-feed gear pair, the second feed gear positioned under the first sieve; repeating the rotation of each of the plurality of drive gear-feed gear pairs in both a counterclockwise and clockwise direction; driving the known quantity of powder through a second sieve into the feed gear of a third drive gear-feed gear pair, the third feed gear positioned under the second sieve; repeating the rotation of each of the plurality of drive gear-feed gear pairs in both a counterclockwise and clockwise direction; driving the known quantity of powder to at least one lower die positioned under the bottom feed gear; pulling the apparatus from directly above the at least one die using the ram system; pressing an upper die against the lower die to form a pellet; raising the lower die/press carrying the pellet; and pushing the apparatus to directly above the at least one lower die and simultaneously pushing the formed pellet into a receptacle.

An object of the invention is to supply a die filling apparatus that ensures a uniform powder is filled into one or more dies consistently.

A second object of the invention is to provide a powder feed assembly that ensures the reduction of powder buildup under the feed gears pushing powder to the die(s).

A third object of the invention is to offer a method of filling dies used to compress powder into a tablet.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
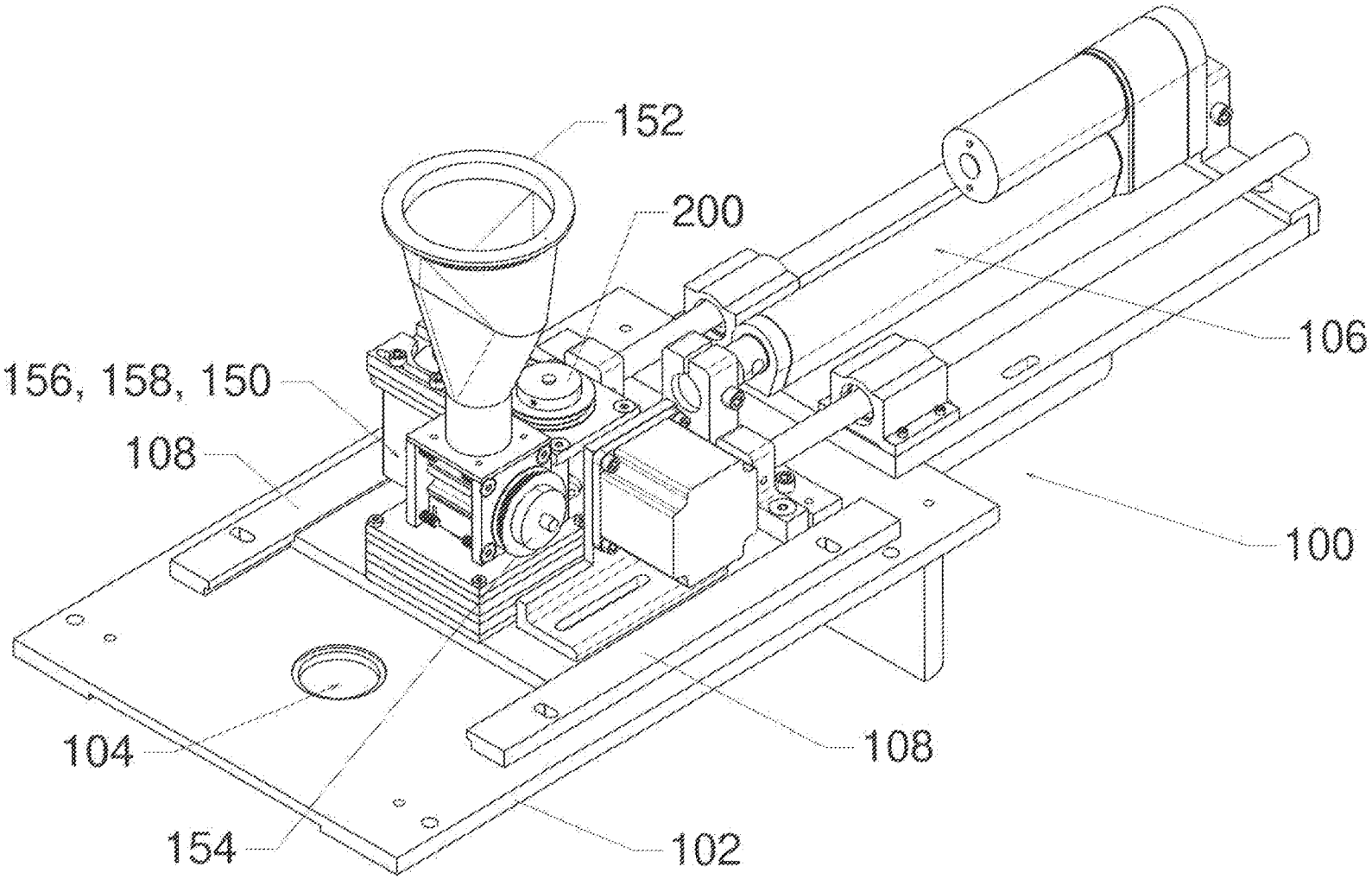
FIG. 1 is a top perspective view of the die filling apparatus of the present invention.

Adverting to the drawings, FIG. 1 is a top perspective view of die filling apparatus 100 ("apparatus 100") of the present invention. Apparatus 100 is supported by base 102. Base 102 also supports tracks 108 and defines die hole 104. Ram system 106 moves apparatus 100 along tracks 108 alternately over and away from die hole 104 as described below.

Powder dispensing assembly 150 ("dispensing assembly 150") receives the powder to be formed into pellets and dispenses it to powder feed mechanism 200 ("feed mechanism 200"). Fill hopper 152 ("hopper 152") receives powder and dispenses a known quantity of the powder to feed assembly 200 positioned directly below hopper 152. Dispensing drive 154 is operatively attached to a powder feed device 156 (shown as a shaded component) located at the bottom of hopper 152 directly over the opening to feed mechanism 200. In the embodiment shown, powder feed device 156 may comprise a plurality of vanes 158 that rotate to supply known quantities of powder to feed mechanism 200.

Figure 2:
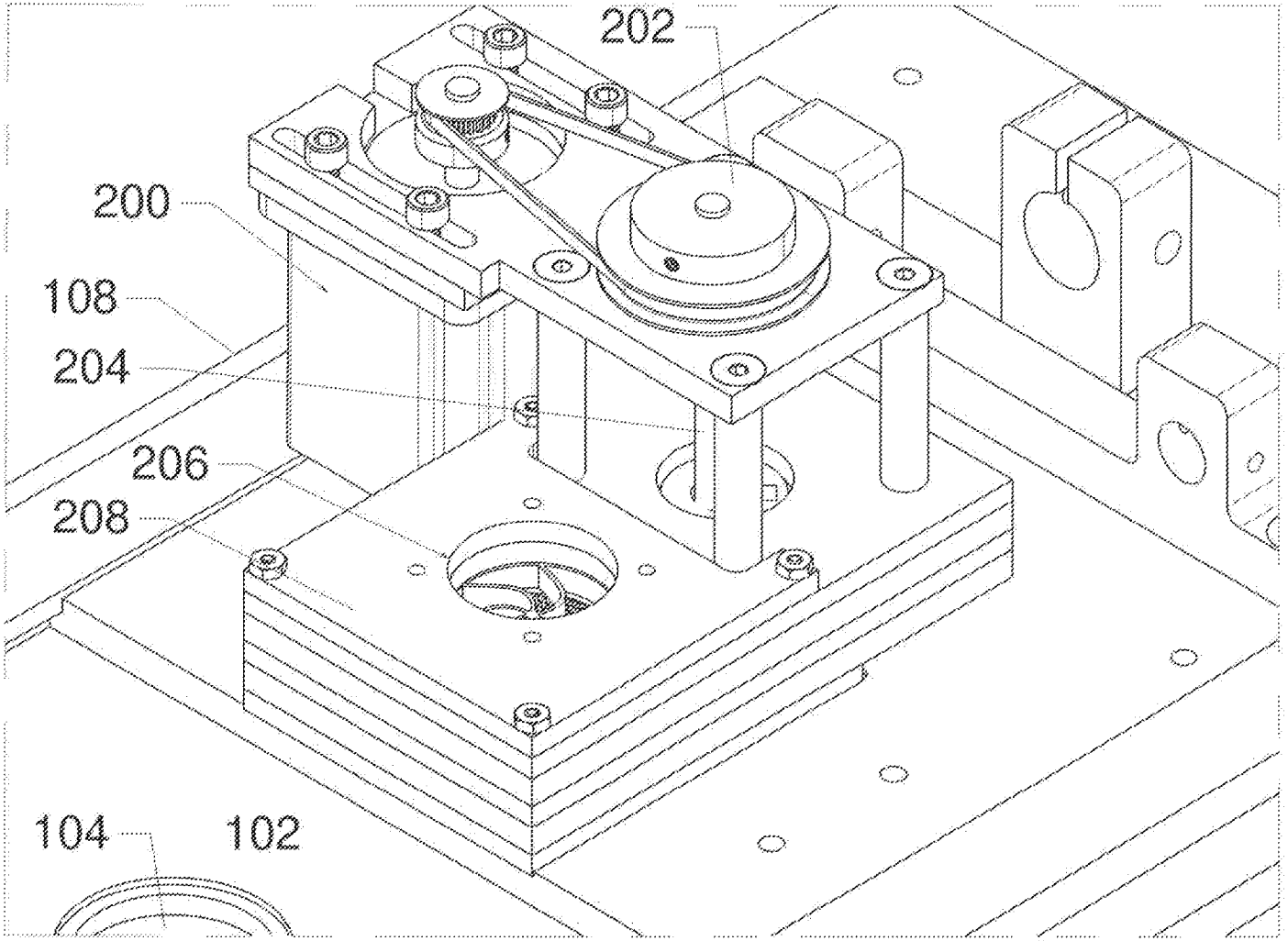
FIG. 2 is a close-up top perspective view of the powder feed mechanism first seen is FIG. 1.

FIG. 2 is a close-up top perspective view of powder feed assembly 200 first seen in FIG. 1. Powder feed drive 202 ("feed drive 202") is operatively attached to a plurality of drive gear-feed gear pairs ("gear pairs") (not seen in FIG. 2) by drive axle 204. Powder feed hole 206 ("hole 206") is defined by housing assembly cover 208 and further defined as a single hole in each of a series of vertically stacked housings-housing cover assemblies 216-219*a* (collectively "assembly 214") as described below. By operatively attached is meant that a component or device is connected either directly or indirectly to a second component and causes that second component to function. For example, as described above, drive axle 204 is described as operatively attached or operationally attached to a plurality of drive gear-feed gear pairs meaning drive axle 204 causes each of the gears of the gear pairs to rotate.

Figure 3:
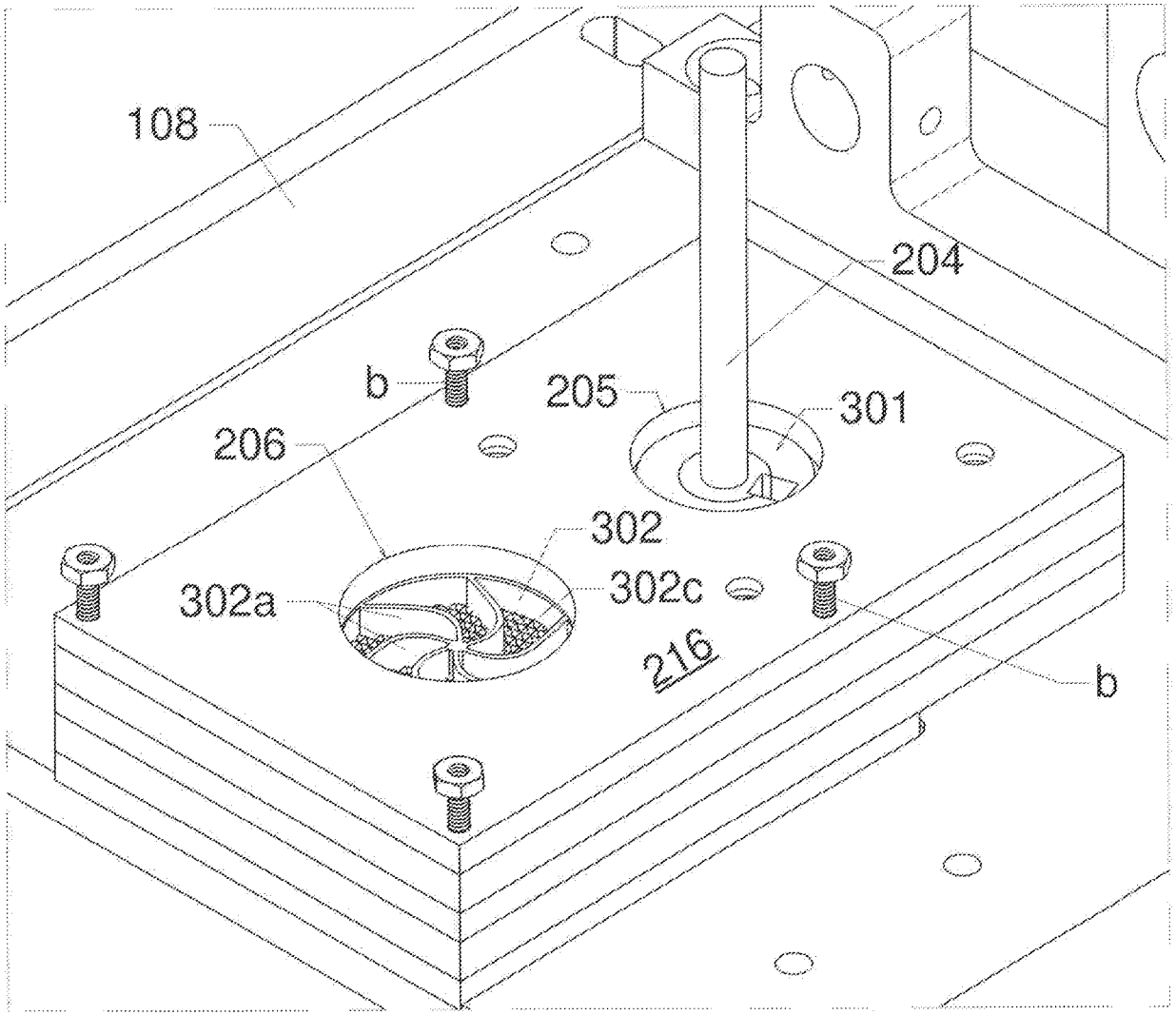
FIG. 3 is a top perspective view of the housings-housing cover assemblies with the cover removed.

FIG. 3 is a top perspective view of housings-housing cover assemblies 216-219*a* with housing assembly cover 208 removed. Drive axle 204 is seen extending into drive hole 205 ("hole 205"). Similar to powder feed hole 206, drive hole 205 is formed as a single hole defined by the series of stacked housings cover-housing assemblies 216-219*a*. Housing cover 216 is the top component of assembly 214. First drive gear 301 can be partially seen through drive hole 205. Also seen is powder feed gear 302 ("feed gear 302") with a plurality of logarithmic extended vanes 302*a*. Sieve 302*c* is seen positioned below feed gear 302. By logarithmic is meant that vanes 302*a* each have a curved shape bent in the same direction relative to the circular inner wall of gear 302. Vanes 302*a* join at a common center point that is equidistant from the inner wall. A plurality of nut and bolt assemblies b hold the components of assembly 214 in place.

Figure 4:
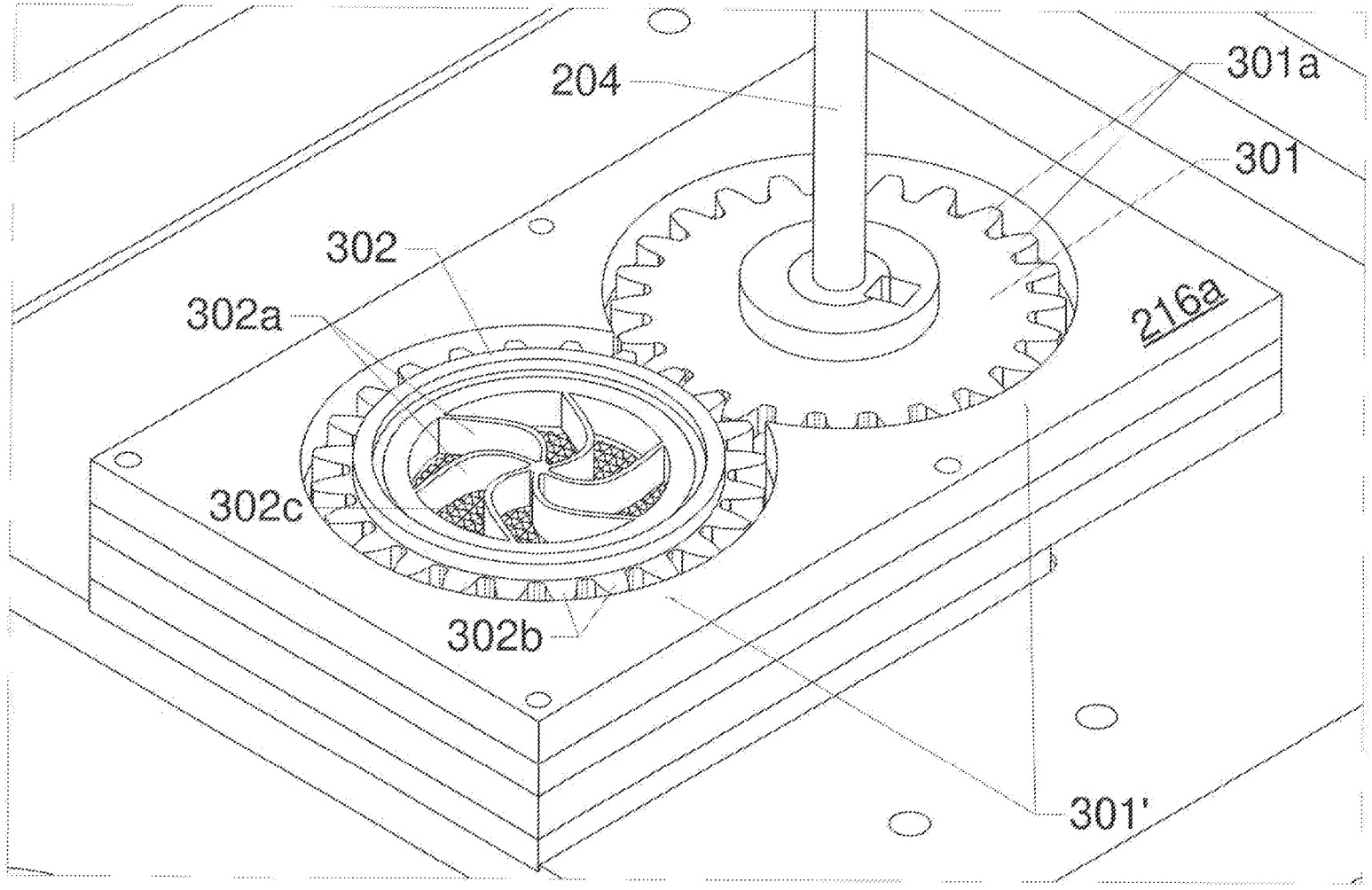
FIG. 4 is a close-up top perspective view of the top housing of the stacked housing cover-housing assemblies with the first housing cover removed.
Figure 5:
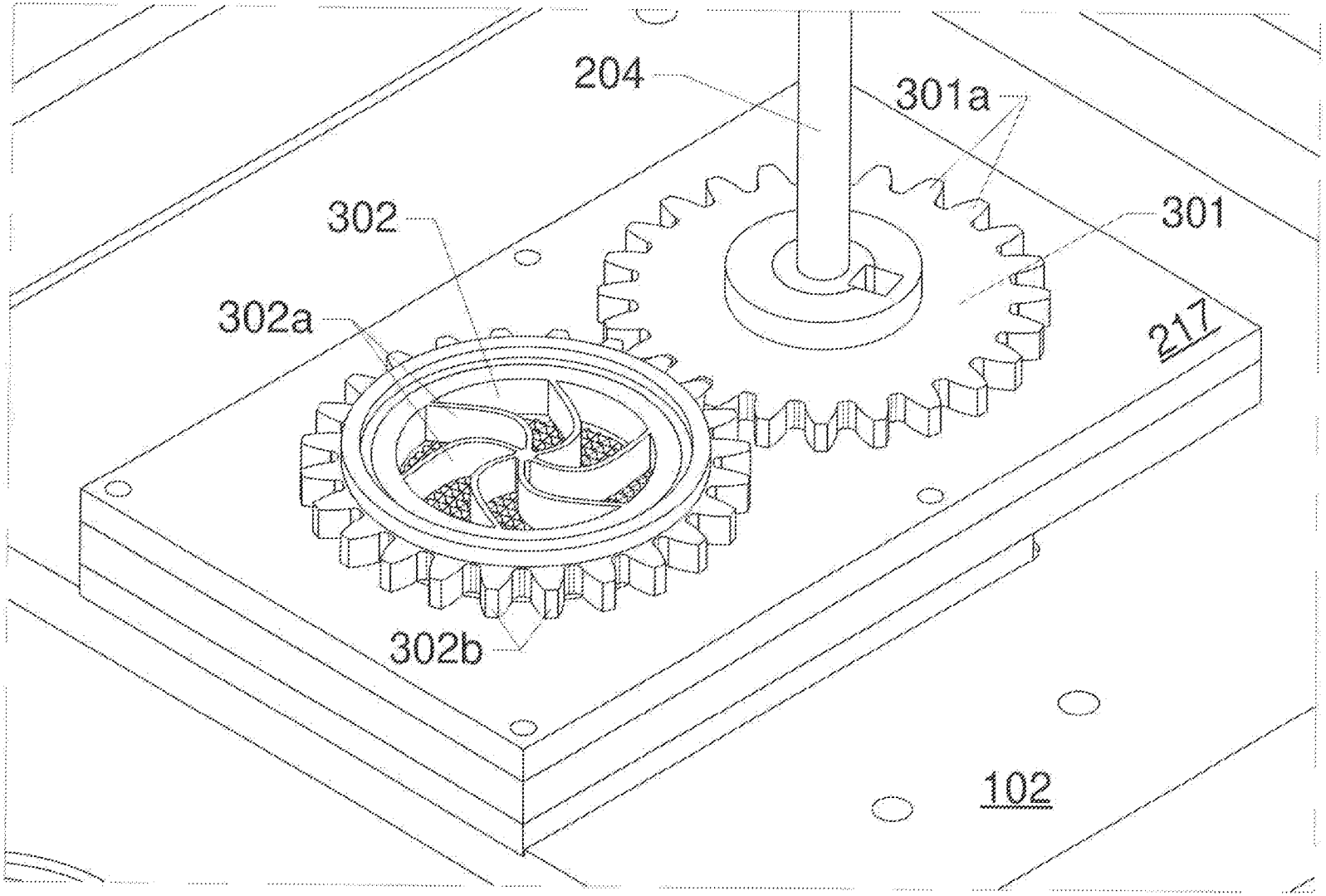
FIG. 5 depicts the top gear pair with the first housing removed showing the top gear pair resting on top of the second housing cover.

FIG. 4 is a top perspective view of top housing 216*a* with housing cover 216 removed. Drive gear 301 and feed gear 302 are more completely seen with drive gear teeth 301*a* interacting with feed gear teeth 302*b* to form a functional attachment between drive gear-feed gear pair 301' nestled in housing 216*a*. By functional attachment is meant that the link i.e., the gear teeth 301*a* and 302*b*, allows feed gear 302 to function, that is rotate. It can be seen that the operative attachment of drive axle 204 to drive gear 301 causes both drive gear 301 and feed gear 302 (collectively "gear pair 301") to rotate demonstrating the operative attachment. FIG. 5 depicts top gear pair 301 with housing 216*a* removed showing gear pair 301 resting on top of second housing cover 217.

Figure 6:
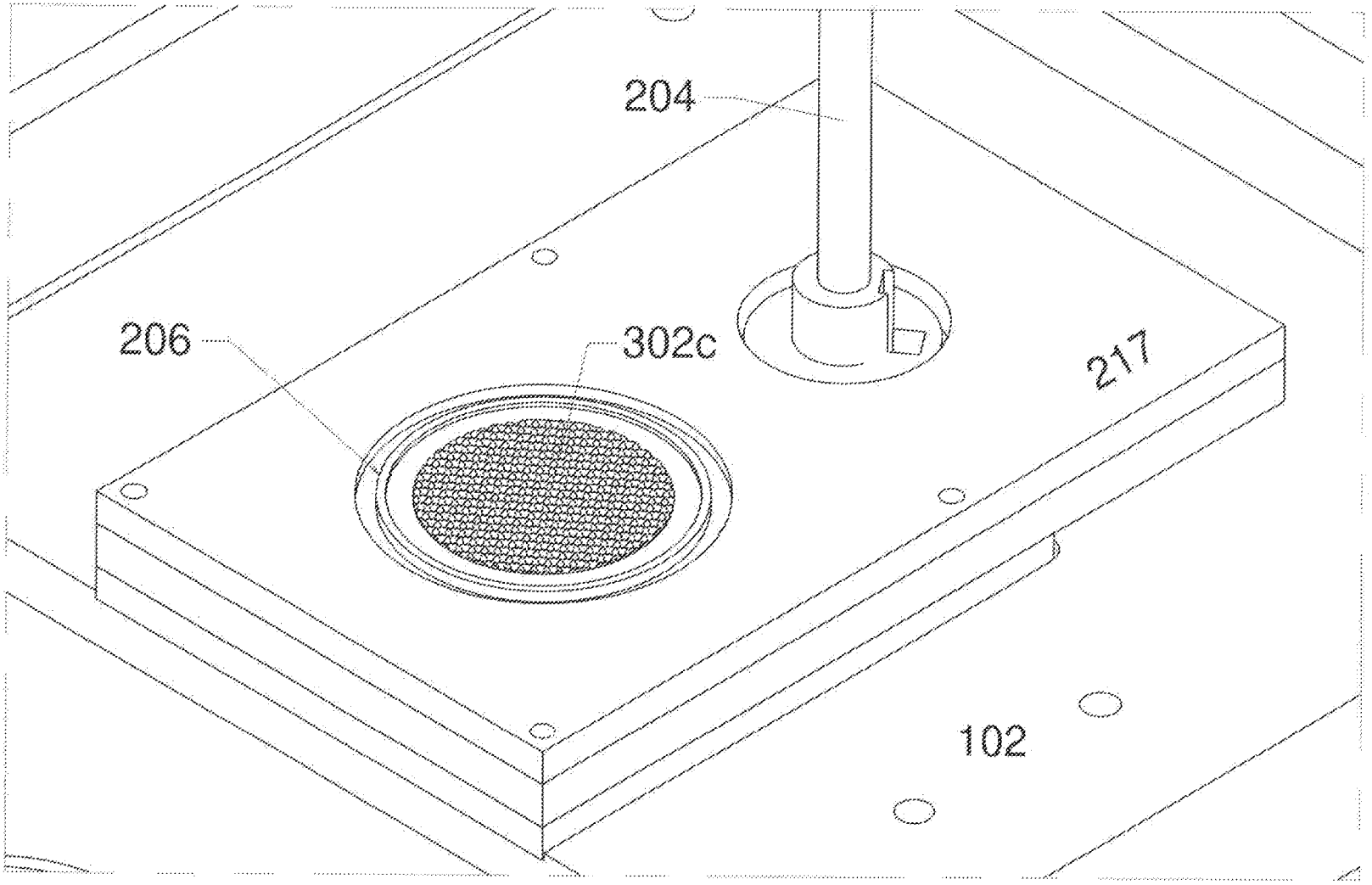
FIG. 6 completely displays the top sieve which is located directly below the top feed gear and is fit or otherwise positioned into the feed hole.

FIG. 6 completely displays sieve 302*c* with feed gear pair 301' removed. Sieve 302*c* is located directly below feed gear 302 as seen above and is fit or otherwise positioned into feed hole 206. As discussed below, the powder is directed from the feed gears through the various sieves into feed hole 206.

Figure 7:
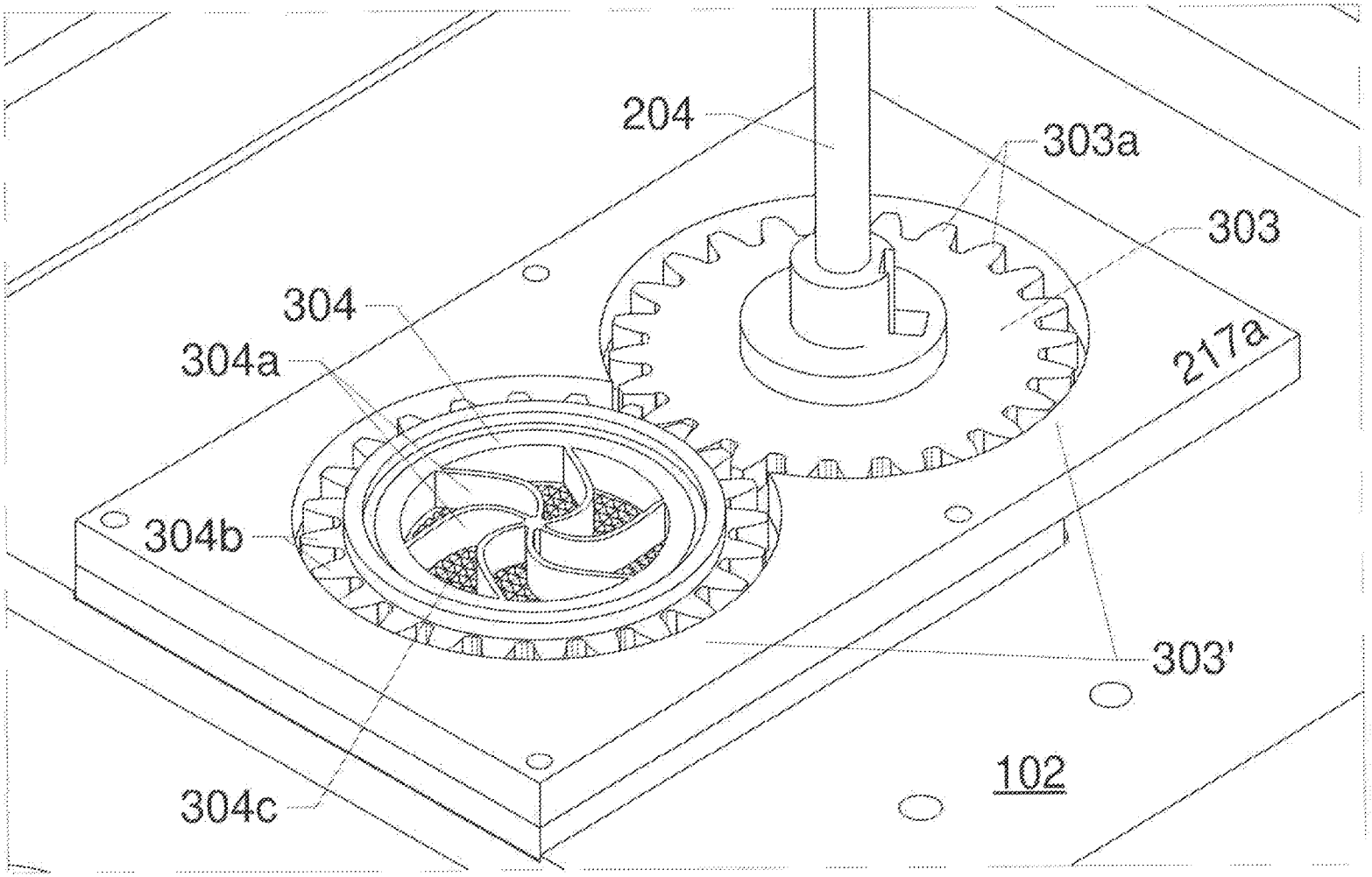
FIG. 7 shows the second gear pair operatively attached to the drive axle and nestled into the second housing.
Figure 8:
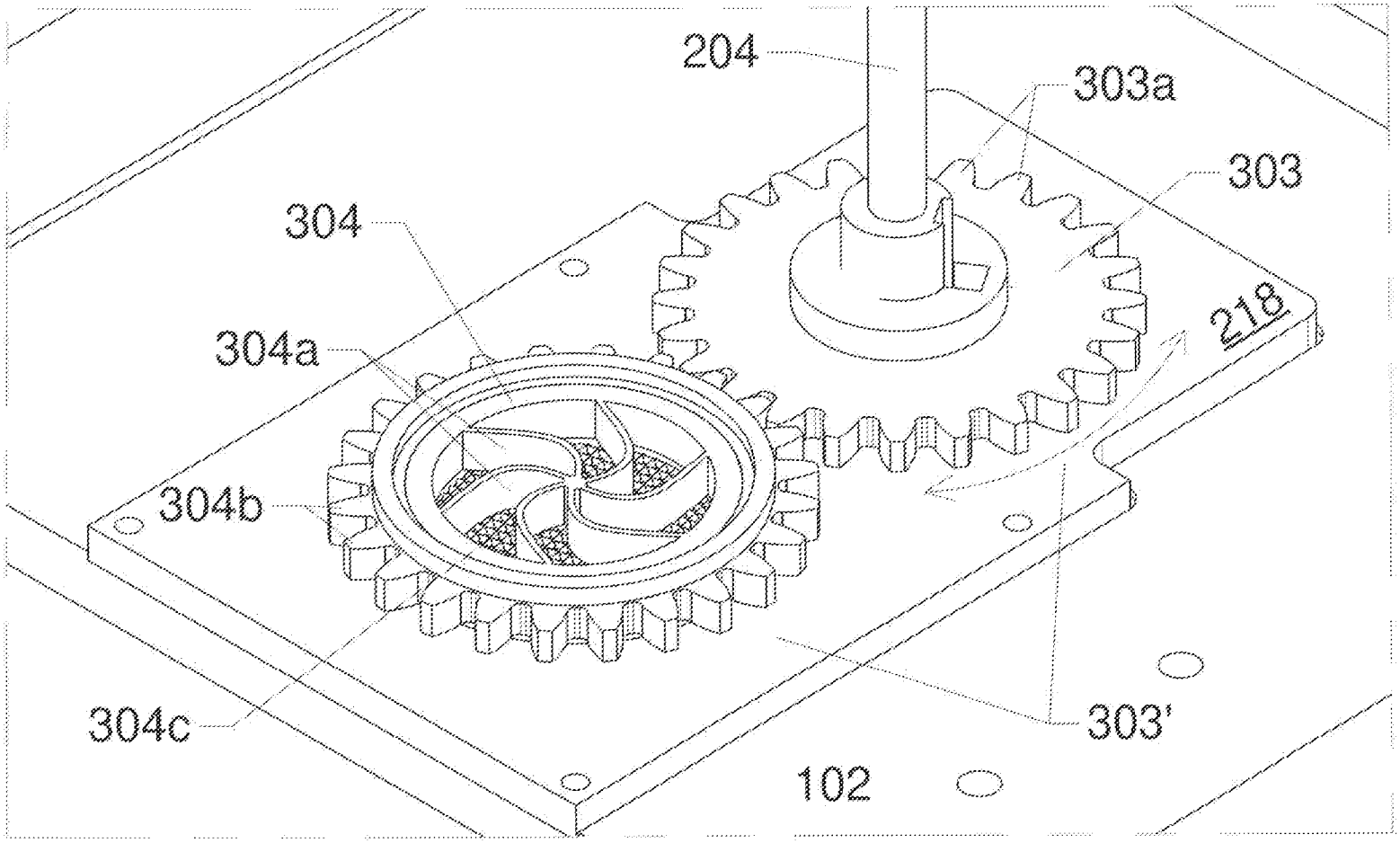
FIG. 8 depicts the second gear pair with the second housing removed shown resting on top of the third housing cover.

FIG. 7 shows second gear pair 303' comprising drive gear 303 operatively attached to drive axle 204 and feed gear 304 with both nestled into housing 217*a*. Similar to gear pair 301', drive gear 303 is functionally attached through gear teeth 303*a* and gear teeth 304*b* to feed gear 304 causing feed gear 304 to rotate. Also seen are logarithmic vanes 304*a*. By functional attachment is meant that the link between one component and a second component allows the second component to function. For example, the functional attachment between drive gear 303 and feed gear 304, namely gear teeth 303*a* and 304*b* enables feed gear 304 to rotate. Sieve 304*c* is positioned in feed hole 206 directly below feed gear 304. FIG. 8 depicts second gear pair 303' with housing 217*a* removed showing gear pair 303' resting on top of third housing cover 218.

Figure 9:
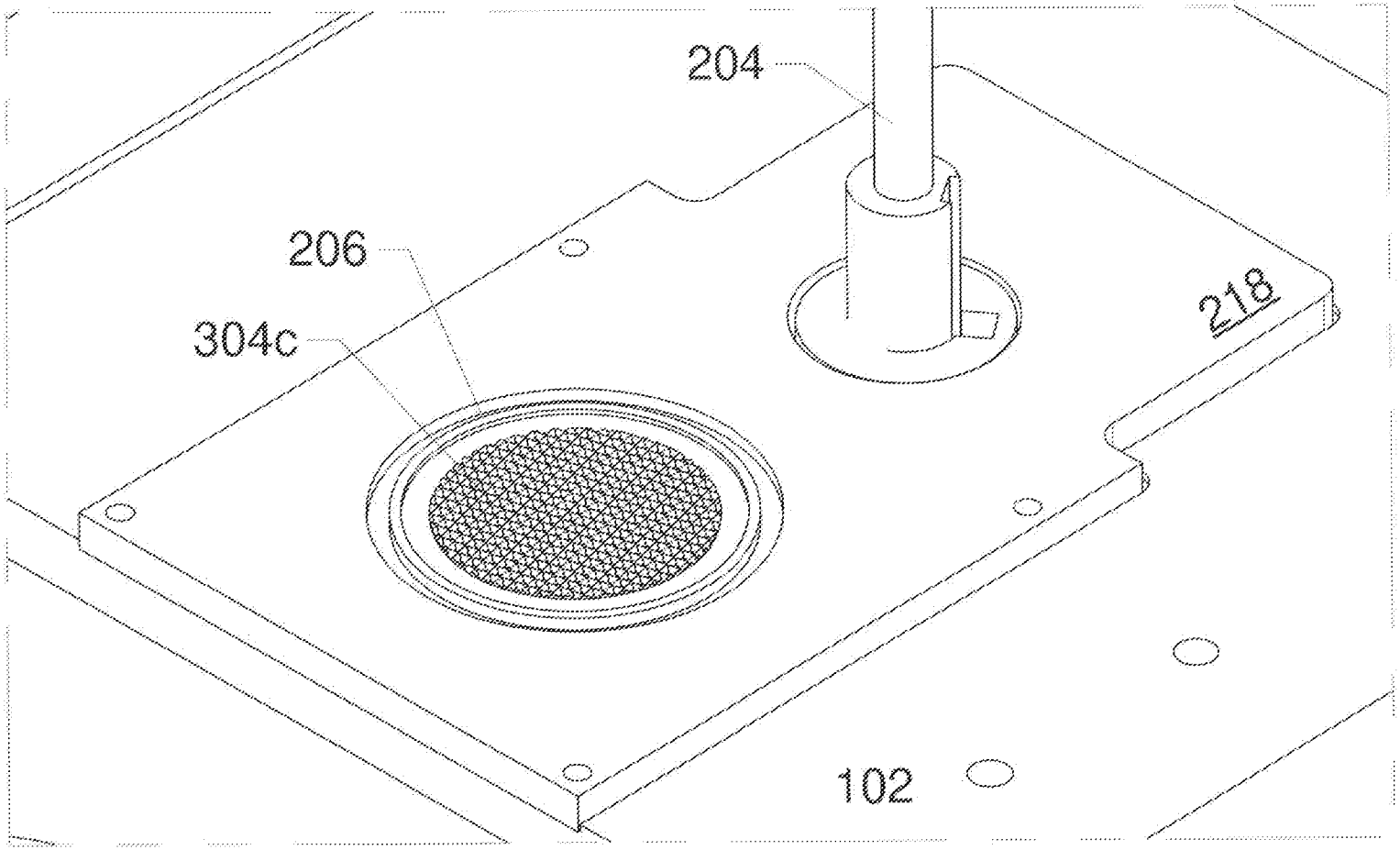
FIG. 9 completely displays the second sieve which is located directly below the second feed gear and is fit or otherwise positioned into the feed hole.

FIG. 9 completely displays sieve 304*c* with gear pair 303' removed. Sieve 304*c* is located directly below feed gear 304 as seen above and is fit or otherwise positioned into feed hole 206.

Figure 10:
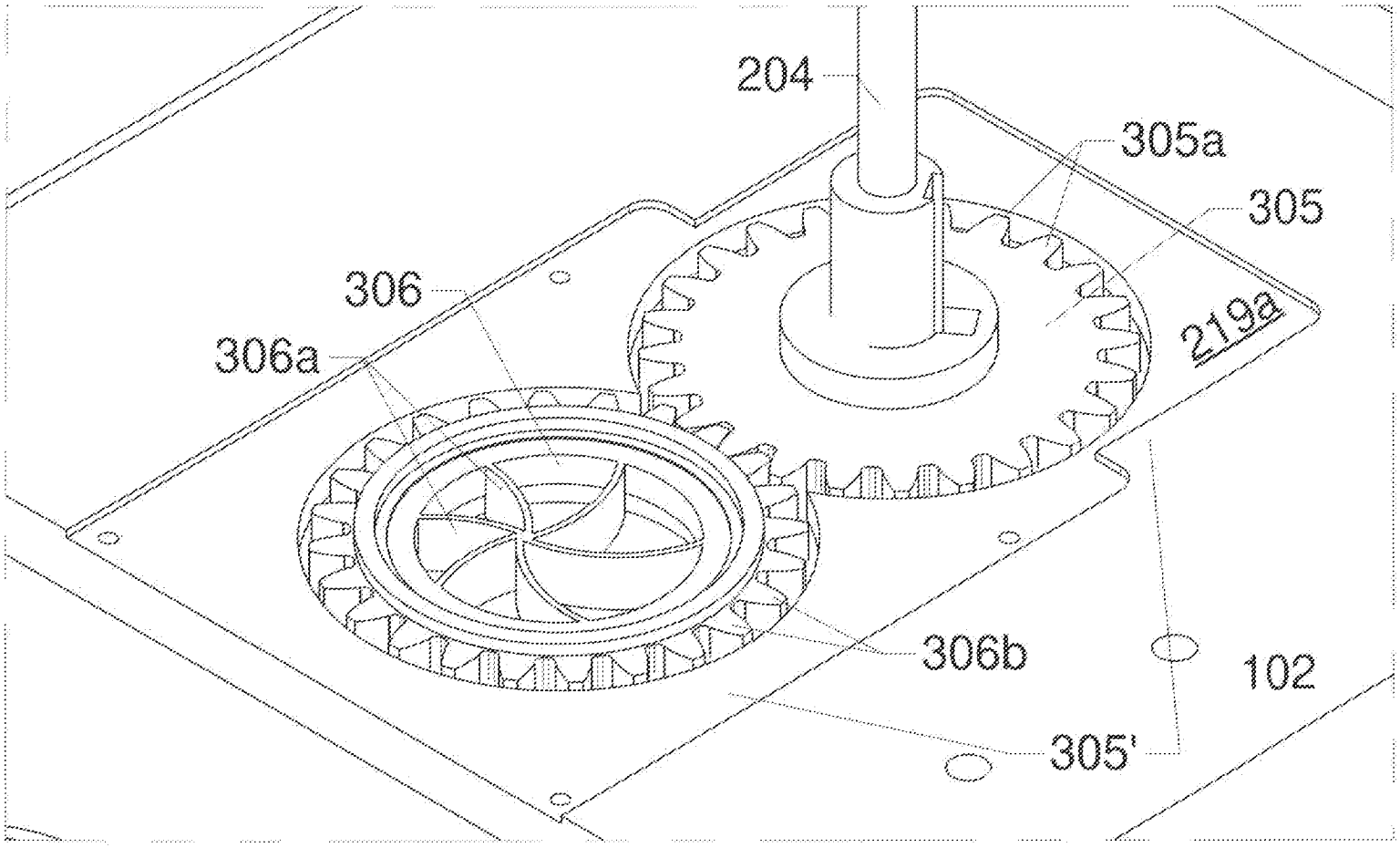
FIG. 10 shows the third gear pair operatively attached to the drive axle and nestled into the third housing.

FIG. 10 shows second gear pair 305' comprising drive gear 305 operatively attached to drive axle 204 and feed gear 306 with both gears nestled into housing 219*a*. Drive gear 305 is functionally attached through gear teeth 305*a* and gear teeth 306*b* to feed gear 306 causing feed gear 306 to rotate. Also seen are logarithmic vanes 306*a*.

Figure 11:
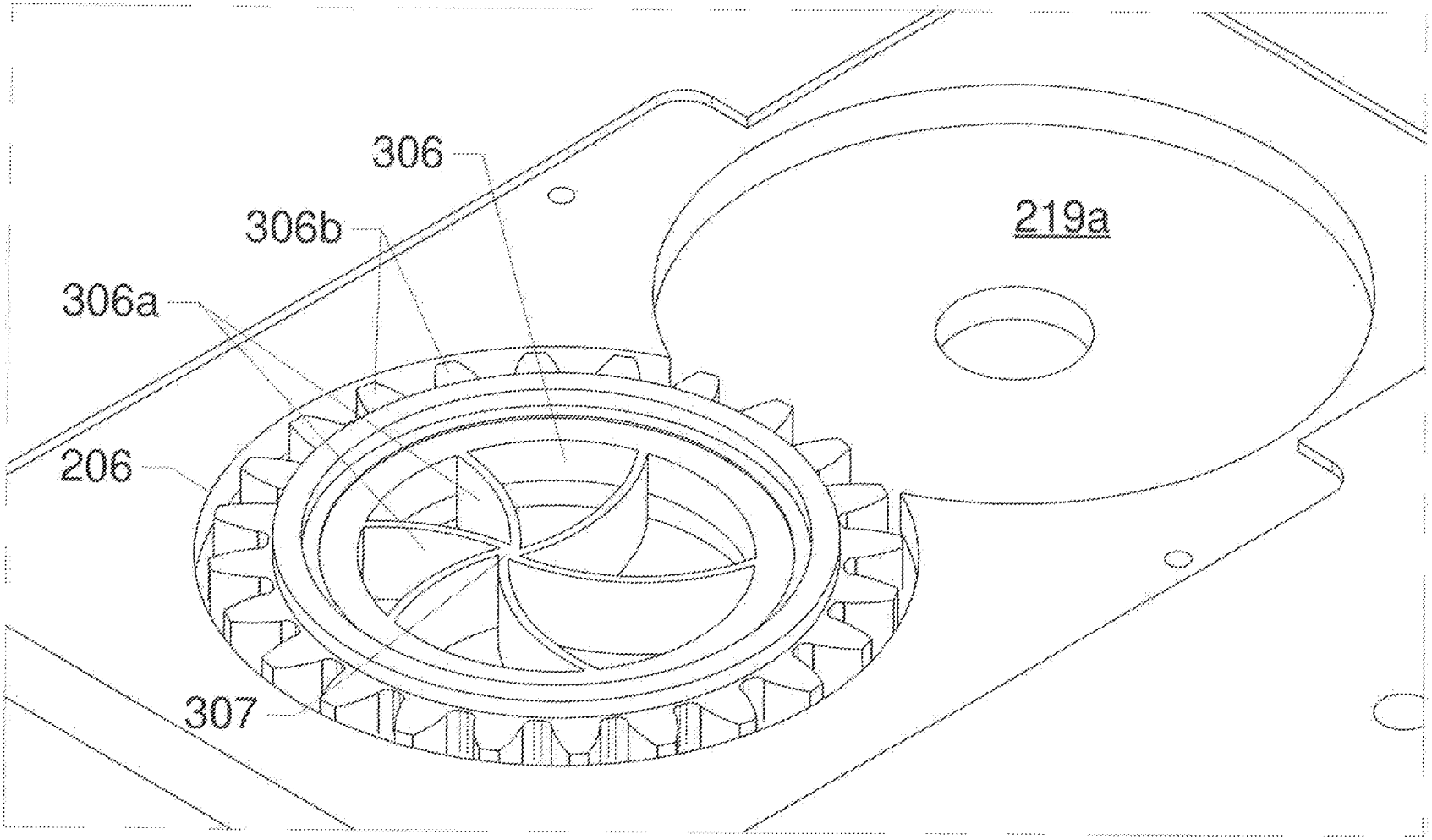
FIG. 11 depicts the bottom feed gear nestled into a well of the bottom housing.

FIG. 11 depicts feed gear 306 nestled into a well of housing 219*a*. Vanes 306*a* are in a uniquely offset configuration in that they meet at a point 307 that is offset or removed to a point away from the axial center of feed gear 306. As explained below, in contrast to the upper housings, the offset configuration of vanes 306*a* provides the advantage of sweeping powder received from sieve 304*c* to vanes 306*a* from the complete surface of the well in housing 219*a*. No powder stays trapped below offset point 307 as it does underneath the axial center point found in feed gears 302 and 304.

Figure 12:
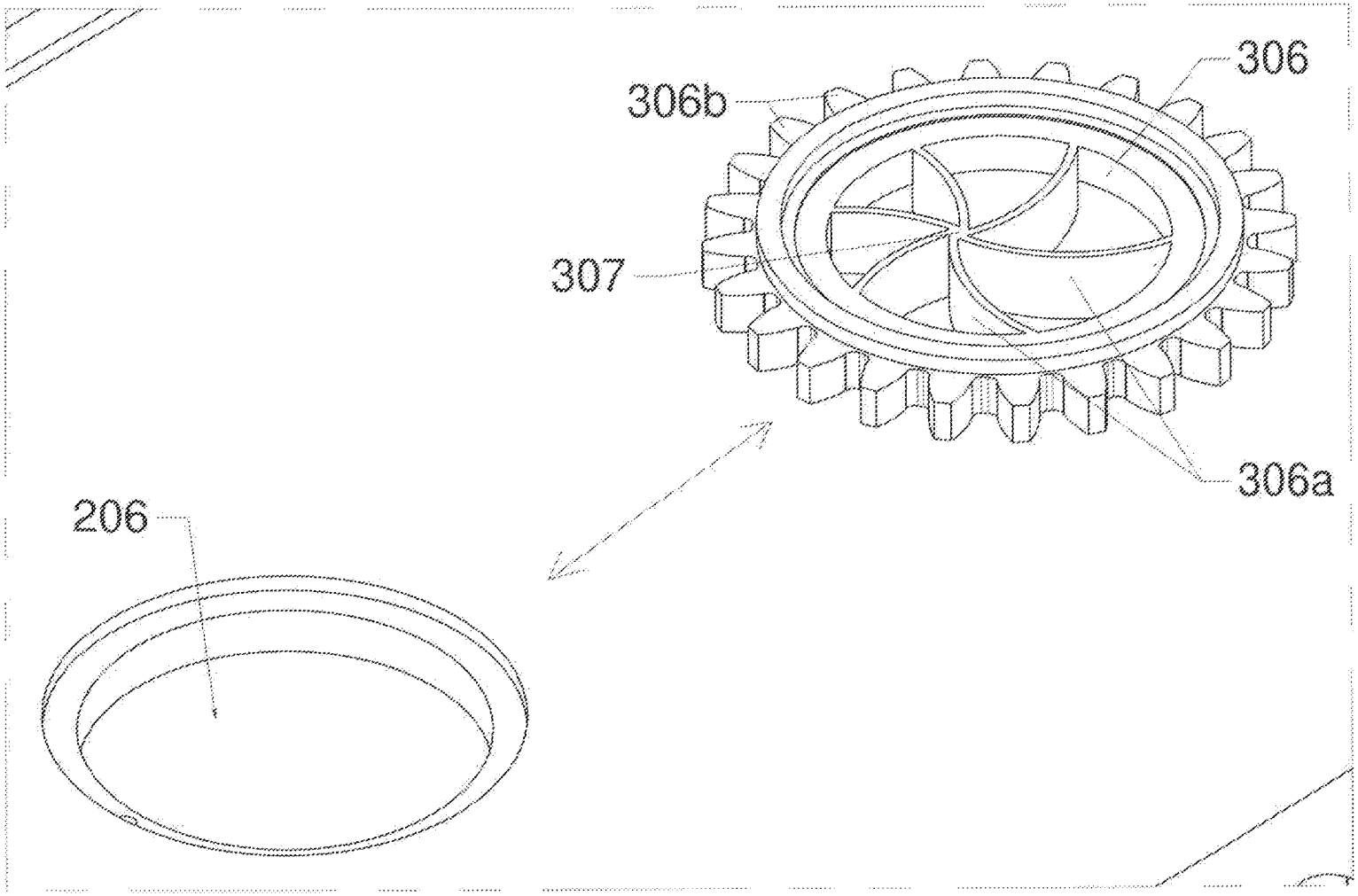
FIG. 12 is a top perspective view of the bottom feed gear displaced from the powder feed hole and providing a clearer view of the offset arrangement of the vanes; and, FIG. 13 is a bottom perspective view of the bottom feed gear showing vane extensions that extend below the plane of the bottom surface of the bottom feed gear.

FIG. 12 is a top perspective view of feed gear 306 displaced from powder feed hole 206 and providing a clearer view of the offset arrangement of vanes 306*a*. As will be described below, the common drive axle 204 rotates each of the gear pairs both clockwise and counter clockwise for each quantity of powder that will make up the pellet. The offset arrangement enables offset point 307 to move laterally relative to the housing floor thereby capturing all the powder to be pushed into feed hole 206. It can be seen that each vane 306*a* possesses the logarithmic curved shape of feed gears 302 and 304, but in contrast to those feed gears, each of vanes 306*a*, though joined at a common point, have different overall lengths to create the offset arrangement of those vanes.

Figure 13:
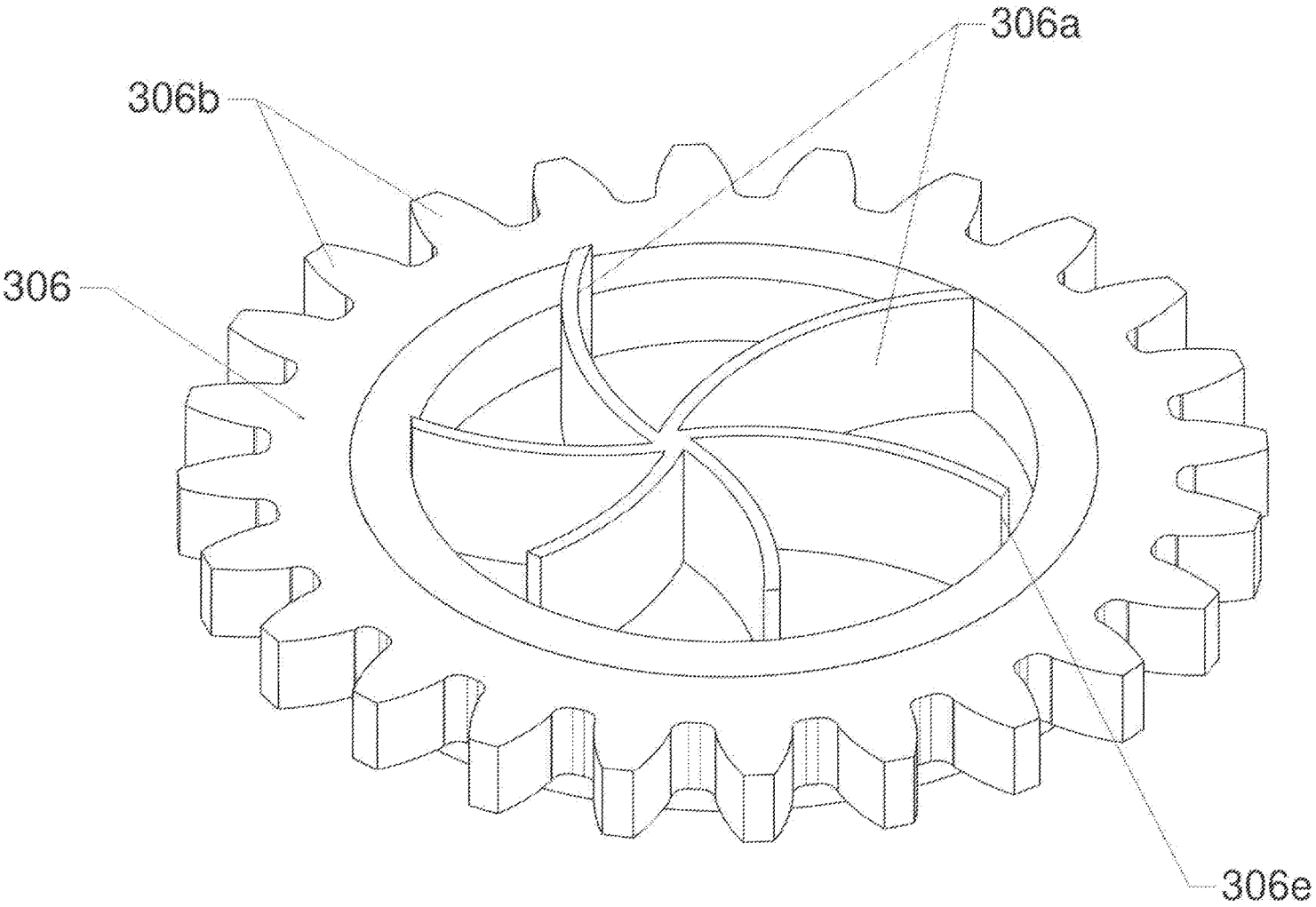

FIG. 13 is a bottom perspective view of feed gear 306 showing the extensions 306*e* of vanes 306*a* that extend below the plane of the bottom surface of feed gear 306. Extensions 306*e* enable feed gear 306 to scrape the powder from the floor of bottom housing 219*a* without interference from the bottom surface of feed gear 306 itself.

In general, apparatus 100 forms pellets from powder by feeding powder from the feed hopper 152 of powder dispensing assembly 150 to feed assembly 200. Powder is fed in predetermined quantities into feed assembly 200 from powder feed device 156. Preferably, powder feed device 156 is positioned directly over feed hole 206 defined by the vertical stack of the plurality of housing covers-housings, i.e. assemblies 214, to enable the powder to flow using gravity. With assembly 214, the top feed gear receives powder from the dispensing drive mechanism, while each feed gear feeds the powder to the lower succeeding feed gear. The die is positioned below feed hole 206 and receives powder after it passes through at least one sieve.

The method for fabricating pellets comprises at least dispensing a known quantity of powder from the powder dispensing assembly into a feed orifice in the top housing cover 216-housing 216*a* of the assembly of housings, rotating each of the plurality of drive gear-feed gear pairs 301', 303' and 305' in both a counterclockwise and clockwise direction, driving the known quantity of powder through a first sieve 302*c* into feed gear 304 of second drive gear-feed gear pair 303', with second feed gear 304 positioned under first sieve 302*c*; repeating the simultaneous rotation of 301', 303' and 305' in both a counterclockwise and clockwise direction; driving the known quantity of powder through second sieve 304*c* into feed gear 306 of third drive gear-feed gear pair 305', third feed gear 306 positioned under second sieve 304*c*; rotating 301', 303' and 305' in both a counterclockwise and clockwise direction; driving the known quantity of powder to at least lower one die positioned under the bottom feed gear; pulling the apparatus from directly above the die using ram system 106; pressing an upper die press or die against the lower die to form a pellet; raising the lower die/press carrying the pellet; pushing apparatus 100 to directly above the at least one lower die and simultaneously pushing the formed pellet into a receptacle. In a preferred embodiment, apparatus 100 is pushed to directly above the at least one lower die while simultaneously pushing the formed pellet into a receptacle such as a hopper or conveyor.

Thus, it is seen that the objects of the invention are efficiently obtained, although changes and modifications to the invention should be readily apparent to those having ordinary skill in the art, which changes would not depart from the spirit and scope of the invention as claimed.

I claim:

1. A powder feed assembly configured to feed a tablet press comprising:

a plurality of drive gear-feed gear pairs, wherein in each of said drive gear-feed gear pairs each drive gear is functionally attached to said feed gear by interlocking gear teeth extending from said drive gear and said feed gear in each of said drive gear-feed gear pairs;

a plurality of housing covers-housings assemblies wherein each of said plurality of housing covers-housings assemblies holds one of said plurality of drive gear-feed gear pairs and wherein each one of said plurality of housing covers-housings assemblies are stacked one above the other;

at least one sieve housing holding a sieve wherein said sieve housing is stacked under a bottom one of said housing covers-housing assemblies; and, said powder feed power drive operatively attached to each of said drive gears; wherein each of said drive gear-feed gear pairs is operatively attached to a common drive axle extending from a powder feed drive to each of said drive gear-feed gear pairs.

2. The assembly of claim 1 wherein said plurality of drive gear-feed gear pairs is three drive gear-feed gear pairs.

3. The assembly of claim 1 wherein said at least one sieve housing is two sieve housings.

4. The assembly of claim 3 wherein one of said sieve housings is under said top housing and said second sieve housing is under a middle housing.

5. The assembly of claim 1 wherein each of said drive gear-feed gear pairs is functionally attached to said powder feed drive by interlocking gear teeth extending from said drive gear and said feed gear in each of said drive gear-feed gear pairs.

6. The assembly of claim 5 wherein said functional attachment is a common drive axle extending from said powder feed drive to each of said drive gear-feed gear pairs.

7. The assembly of claim 1 wherein each of said feed gears includes a plurality of logarithmic vanes and blades from each one of said plurality of logarithmic vanes extend to a floor of each of said housing covers-housing assemblies.

8. The assembly of claim 1 wherein a bottom feed gear includes an offset axis.

9. The assembly of claim 8 wherein a bottom feed gear is housed in an offset housing covers-housings assembly.

10. The assembly of claim 1 further comprising a powder feed hopper attached to said powder feed assembly.

11. An apparatus for die filling with a powder comprising:

a powder dispensing assembly including:

a feed hopper to receive a supply of powder;

a powder feed device operatively attached to said feed hopper;

a dispensing drive mechanism operatively attached to said powder feed device; a powder feed assembly configured to feed a tablet press including:

a plurality of drive gear-feed gear pairs, wherein in each of said drive gear-feed gear pairs, each said drive gear is functionally attached to said feed gear by interlocking gear teeth extending from said drive gear and said feed gear in each of said drive gear-feed gear pairs;

a plurality of housing covers-housings assemblies wherein each of said plurality of housing covers-housings assemblies holds one of said plurality of drive gear-feed gear pairs and wherein each one of said plurality of housing covers-housings assemblies are stacked one above the other;

at least one sieve housing holding a sieve wherein said housing is attached to one of said pluralities of housings; and, a powder feed power drive is operatively attached to each of said drive gears by a common drive axle extending from a powder feed drive to each of said drive gear-feed gear pairs.;

a die; and, at least one press, wherein said at least one press forms said received powder into said die to form a pellet;

wherein a top feed gear receives powder from said dispensing drive mechanism;

wherein said feed gear feeds said powder to a succeeding feed gear;

wherein said at least one die receives powder from a said at least one sieve; and, wherein said apparatus is mounted on a base, said base defining at least one die hole.

12. The apparatus of claim 11 wherein each of said at least one die includes a top die and a lower die.

13. The apparatus of claim 11 wherein each of said drive gears is are functionally attached to a common drive axle extending from said powder feed drive and wherein said powder feed dive rotates said common axle in both a clockwise and counterclockwise direction.

14. The apparatus of claim 11 wherein said apparatus is mounted on a plurality of tracks and further comprising a ram system operatively attached to said device and wherein said ram system alternately pulls said apparatus way from said at least one die and pushes said apparatus over said at least one die.

15. The apparatus of claim 11 wherein said dispensing drive mechanism includes vanes to carry said powder from said feed hopper to said powder feed assembly.

16. A method to fabricate pellets from a powder utilizing an apparatus for die filling with a powder, said apparatus comprising:

an apparatus for forming pellets from a powder comprising: a powder dispensing assembly including:

a feed hopper to receive a supply of powder;

a powder feed device operatively attached to said feed hopper;

a dispensing drive mechanism operatively attached to said powder feed device; a powder feed assembly configured to feed a tablet press including:

a plurality of drive gear-feed gear pairs, wherein in each of said drive gear-feed pairs each said drive gear is functionally attached to said feed gear by interlocking gear teeth extending from said drive gear and said feed gear in each of said drive gear-feed gear pairs;

a plurality of housing covers-housings assemblies wherein each of said plurality of housing covers-housings assemblies holds one of said plurality of drive gear-feed gear pairs and wherein each one of said plurality of housing covers-housings assemblies are stacked one above the other;

at least one sieve housing holding a sieve wherein said housing is attached to one of said housings; and, a powder feed power drive operatively attached to each of said drive gears by a common drive axle extending from a powder feed drive to each of said drive gear-feed gear pairs; wherein said apparatus is mounted on a base, said base defining at least one die hole; a die; and, at least one press, wherein said at least one press forms said received powder into said die to form a pellet;

wherein a top feed gear receives powder from said dispensing drive mechanism;

wherein each feed gear feeds said powder to a succeeding feed gear;

wherein said at least one die receives powder from said at least one sieve through said at least one die hole; and, a ram system operatively attached to said apparatus and wherein said ram system alternately pulls said apparatus way from said at least one die and pushes said apparatus over said at least one die;

wherein a top feed gear receives powder from said dispensing drive mechanism;

wherein each feed gear feeds said powder to a succeeding feed gear;

wherein said at least one die receives powder from said at least one sieve; said method comprising:

dispensing a known quantity of powder from said powder dispensing assembly into a feed orifice in the top housing of said assembly of housings;

rotating each of said plurality of drive gear-feed gear pairs in both a counterclockwise and clockwise direction;

driving said known quantity of powder through a first sieve into said feed gear of a second drive gear-feed gear pair, said second feed gear positioned under said first sieve;

repeating said rotation of each of said plurality of drive gear-feed gear pairs in both a counterclockwise and clockwise direction;

driving said known quantity of powder through a second sieve into said feed gear of a third drive gear-feed gear pair, said second third feed gear positioned under said second sieve;

repeating said rotation of each of said plurality of drive gear-feed gear pairs in both a counterclockwise and clockwise direction;

driving said known quantity of powder to at least one lower die positioned under said bottom feed gear;

pulling said apparatus from directly above said at least one die using said ram system;

pressing an upper die against said lower die to form a pellet;

raising said lower die/press carrying said pellet; and pushing said apparatus to directly above said at least one lower die and simultaneously pushing said formed pellet into a receptacle.

17. The method of claim 16 further comprising driving said known quantity of powder through one or more additional drive gear-feed gear pairs into one or more additional sieves.

18. The method of claim 16 wherein said method is repeated.

19. The method of claim 16 wherein each feed gear comprises vanes and vertical blades extending from said blades to a floor of each of said housings.

20. The method claim 16 wherein said bottom feed gear includes an offset axis.

* * * * *